US006459801B1

(12) United States Patent
Ming-Cheng

(10) Patent No.: US 6,459,801 B1
(45) Date of Patent: Oct. 1, 2002

(54) STRUCTURE FOR ADJUSTING POSITION OF MICROPHONE ON MICROPHONE MOUNT

(75) Inventor: Chung Ming-Cheng, Taichung (TW)

(73) Assignee: Taky Electronics Co., Ltd., Ta-Li City (TW)

( * ) Notice: Subject to any disclaimer, the term of this patent is extended or adjusted under 35 U.S.C. 154(b) by 166 days.

(21) Appl. No.: 09/670,556

(22) Filed: Sep. 27, 2000

(51) Int. Cl.[7] ..... H04R 25/00
(52) U.S. Cl. ..... 381/363; 381/366
(58) Field of Search ..... 381/361, 362, 381/363, 365, 366, 368, FOR 147, 148; 248/324, 311.2, 313

(56) References Cited

U.S. PATENT DOCUMENTS 3,562,446 A * 2/1971 Wolf
4,126,827 A * 11/1978 Negrini
5,454,042 A * 9/1995 Drever
5,757,943 A * 5/1998 Arledge, Jr.
6,219,429 B1 * 4/2002 Chung

* cited by examiner

*Primary Examiner*—Sinh Tran
(74) *Attorney, Agent, or Firm*—Bacon & Thomas, PLLC

(57) ABSTRACT

A microphone mounting structure comprises two lugs extending from the microphone main body, a receiving seat extending from a microphone mount, and a fastening member formed of a threaded rod, a sleeve, a press knob, a fastening bolt, and a spring fitted over the fastening bolt. The threaded rod is actuated by the press knob via the sleeve to force the two lugs of the microphone main body to press against the receiving seat of the microphone mount, so as to, locate the microphone securely in place on the microphone mount. The disengagement of the threaded rod with the press knob is brought about by the spring.

2 Claims, 5 Drawing Sheets

Fig • 1

PRIOR ART

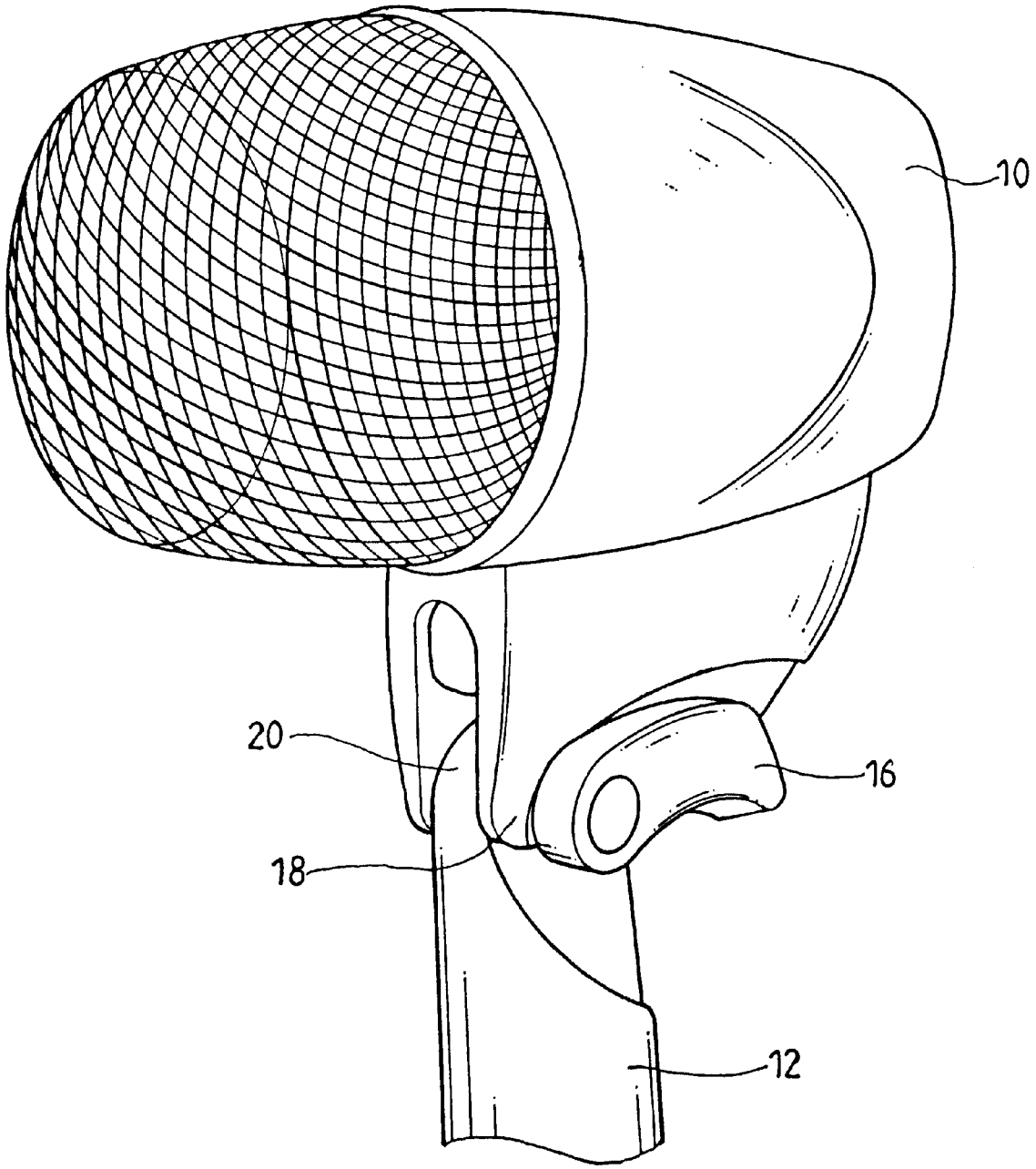
Fig • 3

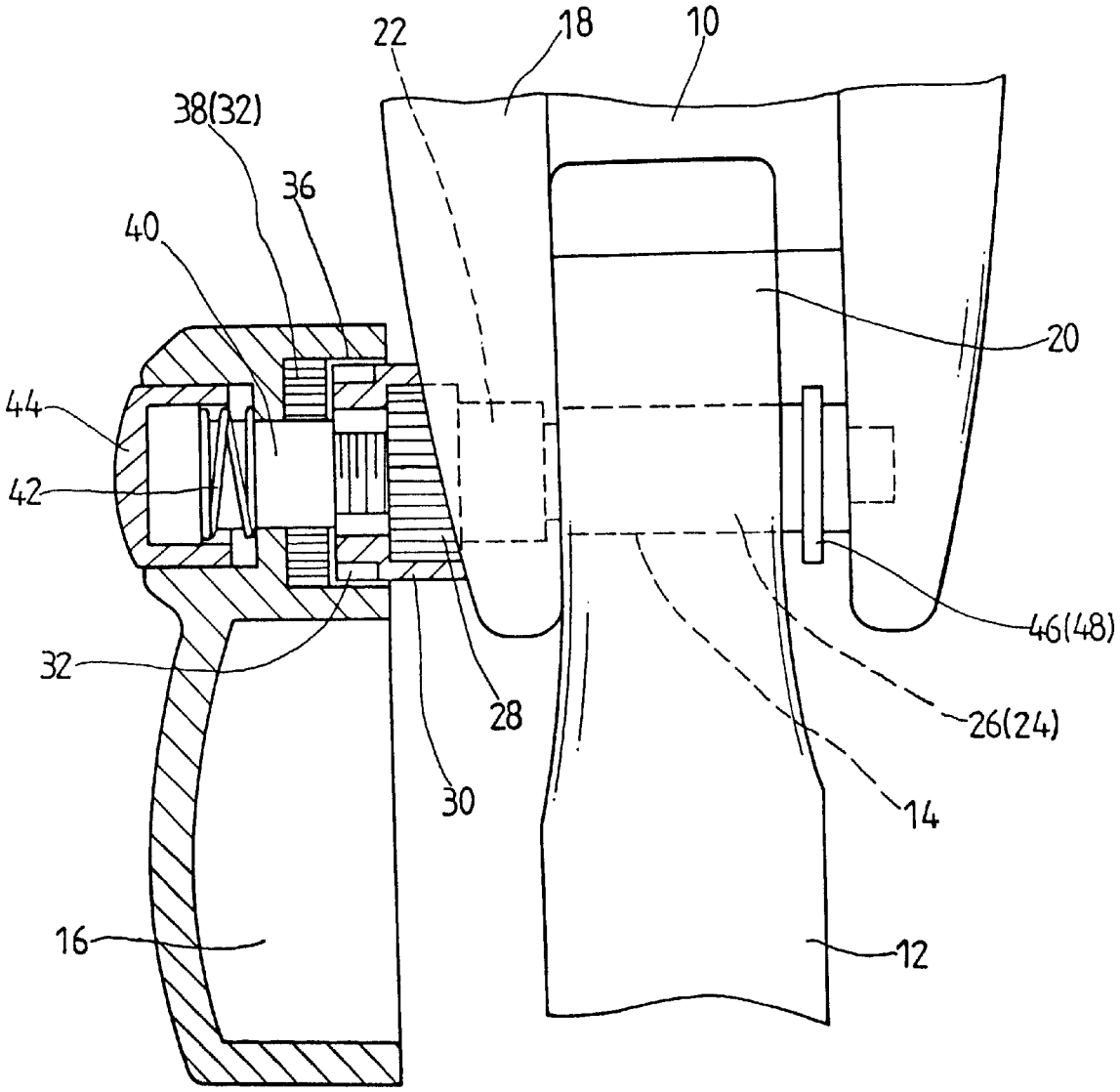
Fig • 4

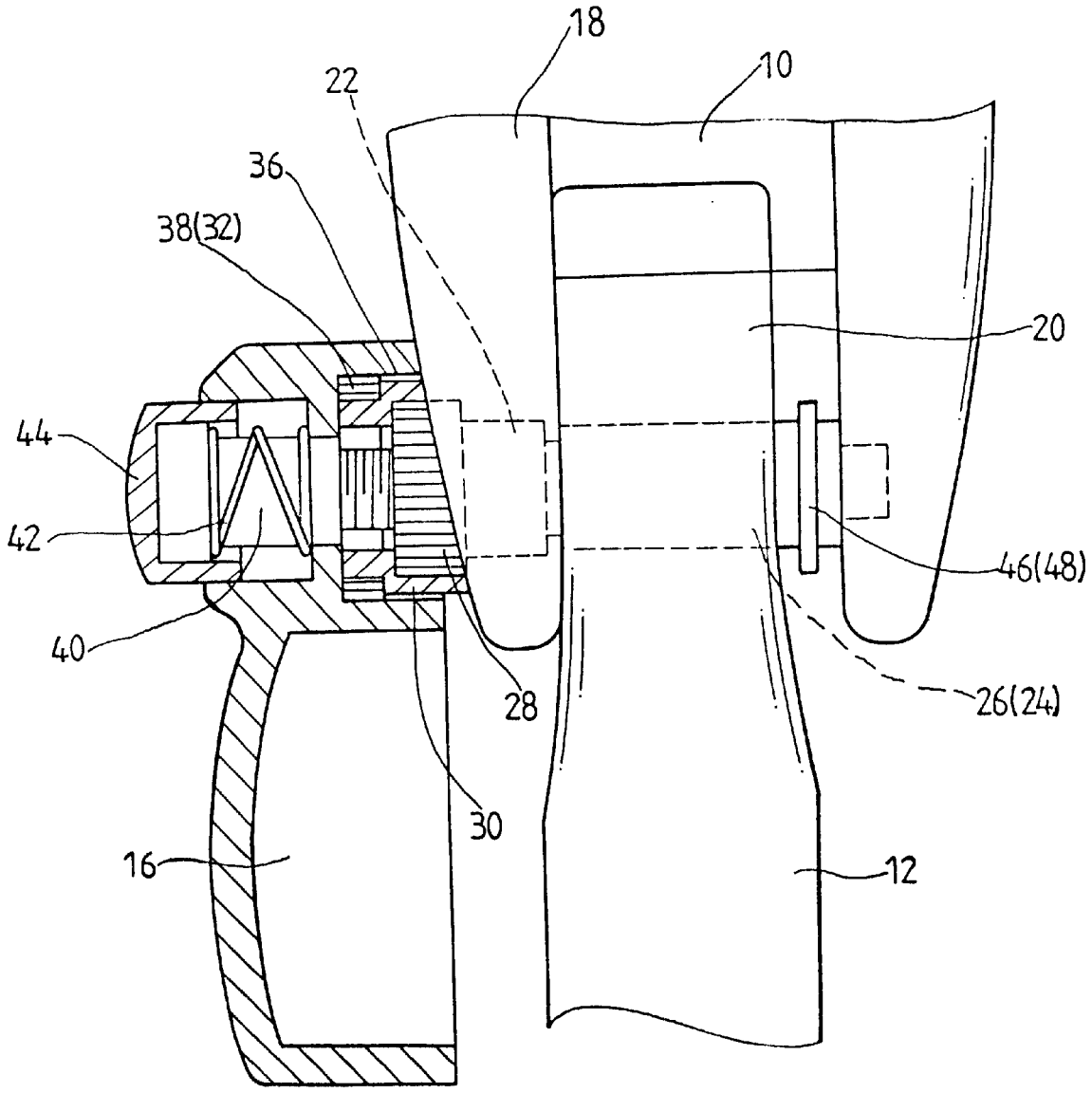
Fig • 5

STRUCTURE FOR ADJUSTING POSITION OF MICROPHONE ON MICROPHONE MOUNT

FIELD OF THE INVENTION

The present invention relates generally to a microphone mount, and more particularly to a structure for adjusting the position of a microphone on the microphone mount.

BACKGROUND OF THE INVENTION

As shown in FIG. 1, a prior art structure for adjusting the position of a microphone main body 11 comprises two lugs 15 extending from the main body 11 and having a through hole 17, a receiving seat 19 having a threaded hole 21 and extending from a microphone mount 13, and a fastening bolt 23. The microphone main body 11 is adjusted mounted on the microphone mount 13 such that the two lugs 15 are mounted on the receiving seat 19 in conjunction with the fastening bolt 23 which is meshed with the threaded hole 21 via the through holes 17 of the two lugs 15. The fastening bolt 23 has a rotary knob 25 and a shank 27 which is fitted into a spring a spring 29. In the light of the fatigue of the spring 29, the microphone main body 11 is apt to become slanted. In addition, the microphone main body 11 is likely to drop on the floor in the event that the fastening bolt 23 is inadvertently unfastened excessively.

SUMMARY OF THE INVENTION

The primary objective of the present invention is to provide a microphone mounting structure free of the drawbacks of the prior art structure described above.

In keeping with the principle of the present invention, the foregoing objective of the present invention is attained by the microphone mounting structure comprising two fastening lugs extending from the microphone main body, a receiving seat extending from a microphone mount, and a fastening member. The fastening lugs of the microphone main body is mounted on the receiving seat of the microphone mount by the fastening member. The fastening member has a threaded rod, a sleeve, and a press knob. The sleeve and the press knob are provided with ratchet teeth enabling the threaded rod to remain in the microphone main body time after time, thereby preventing the microphone main body from dropping.

The features and the advantages of the present invention will be more readily understood upon a thoughtful deliberation of the following detailed description of a preferred embodiment of the present invention with reference to the accompanying drawings.

BRIEF DESCRIPTION OF THE DRAWINGS

FIG. 3 shows a perspective view of the preferred embodiment of the present invention in combination.

FIG. 4 shows a sectional schematic view of the preferred embodiment of the present invention in combination.

FIG. 5 shows another sectional schematic view of the preferred embodiment of the present invention in combination.

DETAILED DESCRIPTION OF THE PREFERRED EMBODIMENT

Figure 1:
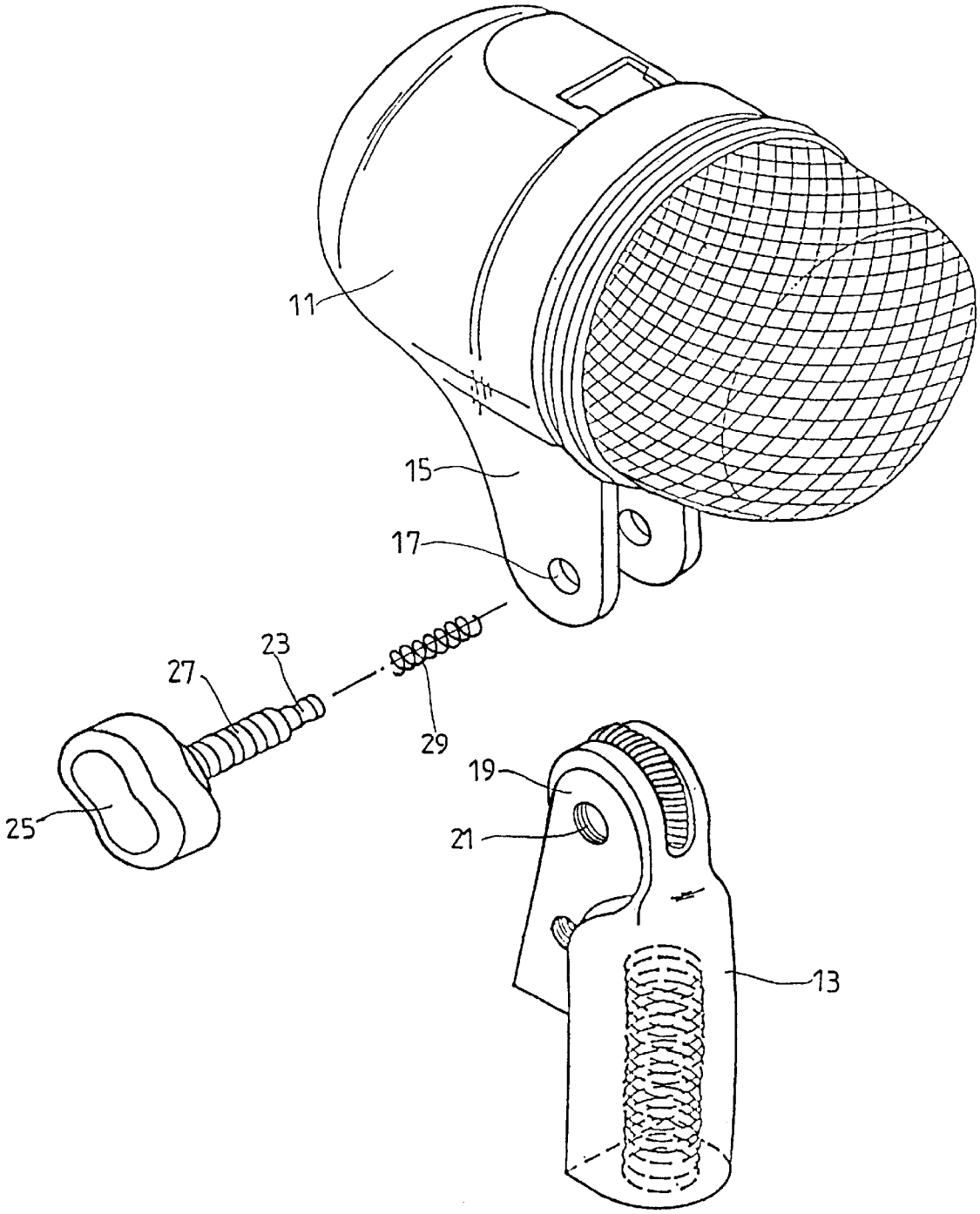
FIG. 1 shows an exploded view of a prior art structure for mounting adjustably a microphone on a microphone mount.
Figure 2:
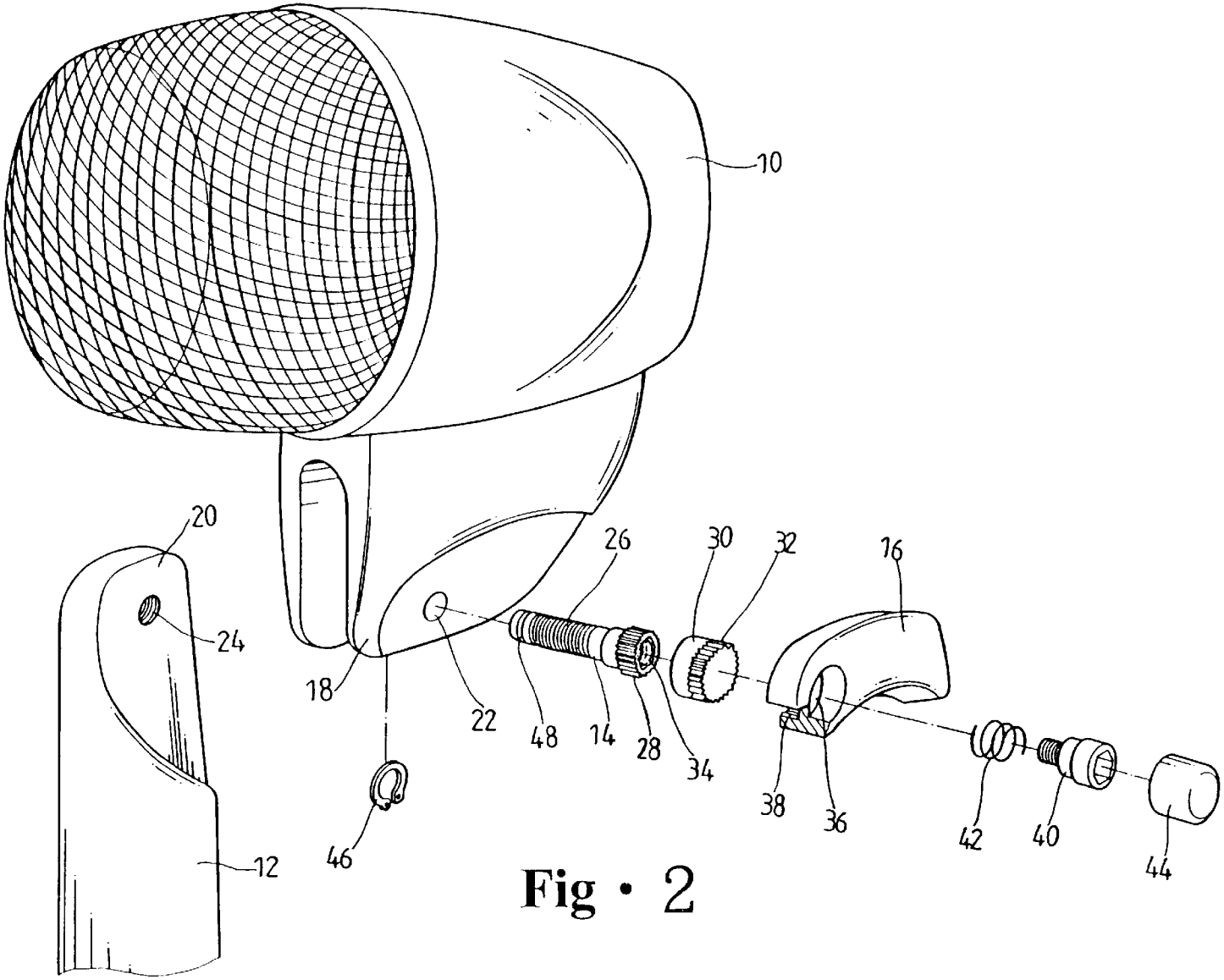
FIG. 2 shows an exploded view of the preferred embodiment of the present invention.

As shown in FIGS. 2–5, a structure embodied in the present invention is intended to mount adjustably a microphone, main body 10 on a microphone mount 12 and is formed of two lugs 18, a receiving seat 20, a threaded rod 14, a press knob 16, and a fastening bolt 40.

The two lugs 18 are extended from the microphone main body 10 and are provided with a through hole 22.

The receiving seat 20 is extended from the microphone mount 12 and is provided with a threaded through hole 24. The receiving seat 20 is dimensioned to fit between the two lugs 18 of the microphone main body 10.

The threaded rod 14 is provided in the outer surface of a shank thereof with outer threads 26, and in a head end thereof with a plurality of ratchet teeth 28. The threaded rod 14 is further provided at the tail end thereof with an annular groove 48 and a retaining ring 46 which is received in the annular groove 48. The threaded rod 14 is further provided with a sleeve 30 having ratchet teeth 32. The sleeve 30 is fitted over the head end of the threaded rod 14.

The press knob 16 is provided at one end with a through hole 36 which is provided with a plurality of ratchet teeth 38.

The fastening bolt 40 is provided with a spring 42 fitted thereover.

In combination, the microphone main body 10 is adjustably mounted on the receiving seat 20 of the microphone mount 12 such that the receiving seat 20 disposed between the two lugs 18 of the microphone main body 10, and that the microphone main body 10 is secured in place by the threaded rod 14 which is engaged with the threaded through hole 24 of the receiving seat 20 via the through holes 22 of the lugs 18. In the meantime, the press knob 16 is pivotally fastened with the threaded rod 14 in conjunction with the fastening bolt 40 which is engaged with a threaded hole 34 of the head end of the threaded rod 14 via the through hole 36 of the press knob 16, and the sleeve 30. As the ratchet teeth 32 of the sleeve 30 of the threaded rod 14 are meshed with the ratchet teeth 38 of the press knob 16, the threaded rod 14 can be actuated by the press knob 16 to turn, so as to adjust the position of the microphone 10 in relation to the microphone mount 12. In addition, the threaded rod 14 can be actuated by the press knob 16 to force the two lugs 18 to press against the receiving seat 20 in conjunction with the retaining ring 46, thereby locating the microphone 10 in place on the receiving seat 20 of the microphone mount 12.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A microphone mount structure comprising:

a microphone main body having two lugs, with each having through hole;

a microphone mount having a receiving seat with a threaded through hole; and a fastening member for fastening said microphone main body with said microphone mount such that said receiving seat is fitted between said two lugs of said microphone main body, and that said fastening member is engaged with said threaded through hole of said receiving seat via one of said through holes of said lugs;

wherein said fastening member comprising:

a threaded rod provided on a shank thereof with outer threads which are engaged with said threaded through hole of said receiving seat via one of said through holes of said lugs, said threaded rod further provided at a head end thereof with ratchet teeth and a sleeve fitted thereover, said sleeve provided in an outer surface thereof with ratchet teeth, said threaded rod further provided at the head end thereof with a threaded hole;

a press knob provided at one end with a through hole having ratchet teeth, said press knob being rotatably fasted with said threaded rod such that said sleeve of said head end of said threaded rod is fitted into said through hole of said press knob, and that said ratchet teeth of said press knob are disengageably meshed with said ratchet teeth of said sleeve whereby said press knob is further provided with a fastening bolt and a spring fitted over said fastening bolt, with said fastening bolt being engaged with said threaded hole of said head end of said threaded rod via said through hole of said press knob, said press knob capable of actuating said threaded rod to turn to force said two lugs of said microphone main body to press against said receiving seat of said microphone mount at such time when said ratchet teeth of said press knob are meshed with said ratchet teeth of said sleeve of said head end of said threaded rod, whereby said spring is used to bring about disengagement of said ratchet teeth of said press knob with said ratchet teeth of said sleeve of said threaded rod.

2. The microphone mount structure as define in claim 1, wherein said threaded rod has a tail end opposite to said head end and provided with an annular groove and a retaining ring disposed in said annular groove.

* * * * *